US008160291B2

(12) United States Patent
Imamura et al.

(10) Patent No.: US 8,160,291 B2
(45) Date of Patent: Apr. 17, 2012

(54) VOICE COIL AND SPEAKER

(75) Inventors: Satoshi Imamura, Yokohama (JP); Shinji Kamimura, Yokohama (JP); Junji Iino, Yokohama (JP)

(73) Assignee: Victor Company of Japan, Limited, Yokohama (JP)

( * ) Notice: Subject to any disclaimer, the term of this patent is extended or adjusted under 35 U.S.C. 154(b) by 822 days.

(21) Appl. No.: 12/222,910

(22) Filed: Aug. 19, 2008

(65) Prior Publication Data

US 2009/0060253 A1 Mar. 5, 2009

(30) Foreign Application Priority Data

Aug. 27, 2007 (JP) ..... 2007-220040

(51) Int. Cl.
*H04R 9/06* (2006.01)

(52) U.S. Cl. ..... 381/407

(58) Field of Classification Search ..... 381/407
See application file for complete search history.

(56) References Cited

U.S. PATENT DOCUMENTS

| | | | | |
|---|---|---|---|---|
| 3,952,963 | A | 4/1976 | Ueno et al. | |
| 4,878,412 | A * | 11/1989 | Resnick | 84/726 |
| 2008/0166010 | A1* | 7/2008 | Stiles et al. | 381/423 |

FOREIGN PATENT DOCUMENTS

| | | | |
|---|---|---|---|
| JP | 58007758 | | 1/1983 |
| JP | 59009512 | | 1/1984 |
| JP | 8-107597 | A | 4/1996 |
| JP | 08-275292 | | 10/1996 |
| JP | 09-093694 | | 4/1997 |
| JP | 09-093695 | | 4/1997 |
| JP | 2002093638 | | 3/2002 |
| JP | 2002-300697 | | 10/2002 |
| JP | 2004254013 | | 9/2004 |
| JP | 2005229442 | | 8/2005 |
| JP | 2005354733 | | 12/2005 |
| KR | 90-13904 | U | 7/1990 |
| KR | 20-0141945 | Y1 | 3/1998 |

OTHER PUBLICATIONS

Korean Office Action of Counterpart Korean Application, issued on Jun. 28, 2010.
Official Action issued on Sep. 15, 2011 in the counterpart Chinese application.
Office Action dated Nov 22, 2011 from counter-part Japanese Application, with English translation.
Official Action issued on Sep. 15, 2011 in the counterpart Chinese application.

* cited by examiner

*Primary Examiner* — Alexander G. Ghyka
*Assistant Examiner* — Stanetta Isaac
(74) *Attorney, Agent, or Firm* — The Nath Law Group; Jerald L. Meyer; Stanley N. Protigal

(57) ABSTRACT

A voice coil includes a bobbin formed of a wooden sheet obtained by slicing natural wood to a predetermined thickness and a coil that surrounds an outer circumference of the bobbin.

10 Claims, 8 Drawing Sheets

VOICE COIL AND SPEAKER

CROSS REFERENCE TO RELATED APPLICATIONS

This application is based upon and claims the benefit of priority from the prior Japanese Patent Applications No. P2007-220040 filed on Aug. 27, 2007; the entire contents of which are incorporated herein by reference.

BACKGROUND OF THE INVENTION

1. Field of the Invention

The present invention relates to a voice coil composed of a bobbin and a coil, and a speaker using the voice coil.

2. Description of the Related Art

In a dynamic speaker, a bobbin is vibrated by a change of a current flowing through a coil wound around a bobbin, and vibrations thus generated are transmitted to a diaphragm. Accordingly, as a material that forms the bobbin of the voice coil, it is preferable to select a material that easily transmits the vibrations to the diaphragm. For the conventional bobbin, various materials such as kraft, aluminum, aramid fiber and polyimide are used (for example, Japanese Unexamined Patent Application Laid-Open (Koukai) No. 2002-300697).

However, in the case of using the conventional material, for example, the kraft, though the kraft is lightweight, and a sound pressure thereof in a mid/treble range is high, strength of the bobbin falls short, and accordingly, a feeling of distortion in the treble range is sensed in some cases. Moreover, in the case of using the kraft, a sound propagation velocity is relatively slow. In the case of using the aluminum, the strength of the bobbin is enhanced and the sound propagation velocity is increased in comparison with the case of using the kraft. However, since magnetic damping is applied to the bobbin, sound articulation in a bass range is not very satisfactory in some cases. Moreover, since specific gravity of the aluminum is larger than that of the kraft, a sound pressure thereof in the mid/treble range is sometimes decreased.

In the case of using the aramid fiber, though the aramid fiber is preferable for the bass range since specific gravity thereof is large, the aramid fiber is unsuitable for full range and mid/treble speakers. Moreover, also in the case of using the polyimide, though it is necessary to reduce weight of the bobbin by thinning a thickness thereof since specific gravity of the polyimide is large, the strength of the bobbin falls short when the thickness is thinned, and accordingly, a treble resonance occurs in some cases.

As described above, each of the materials used heretofore has merits and demerits, and there have not been obtained yet a voice coil and a speaker, which use a material that has a high propagation velocity, is lightweight and strong, and is capable of transmitting the vibrations with high efficiency.

SUMMARY OF THE INVENTION

The present invention provides a voice coil and a speaker, which have the high propagation velocity, are lightweight and strong, and are capable of transmitting the vibrations with high efficiency.

An aspect of the present invention inheres in a voice coil encompassing a bobbin formed of a wooden sheet obtained by slicing natural wood to a predetermined thickness; and a coil that surrounds an outer circumference of the bobbin.

Another aspect of the present invention inheres in a speaker encompassing a bobbin formed of a wooden sheet obtained by slicing natural wood to a predetermined thickness; a coil that surrounds an outer circumference of the bobbin; a diaphragm connected to an end portion of the coil; and a magnetic circuit magnetically connected to the coil.

DESCRIPTION OF THE PREFERRED EMBODIMENTS

Various embodiments of the present invention will be described with reference to the accompanying drawings. In the following descriptions, numerous details are set forth such as specific signal values, etc. to provide a thorough understanding of the present invention. However, it will be obvious to those skilled in the art that the present invention may be practiced without such specific details.

—Speaker—

Figure 1:
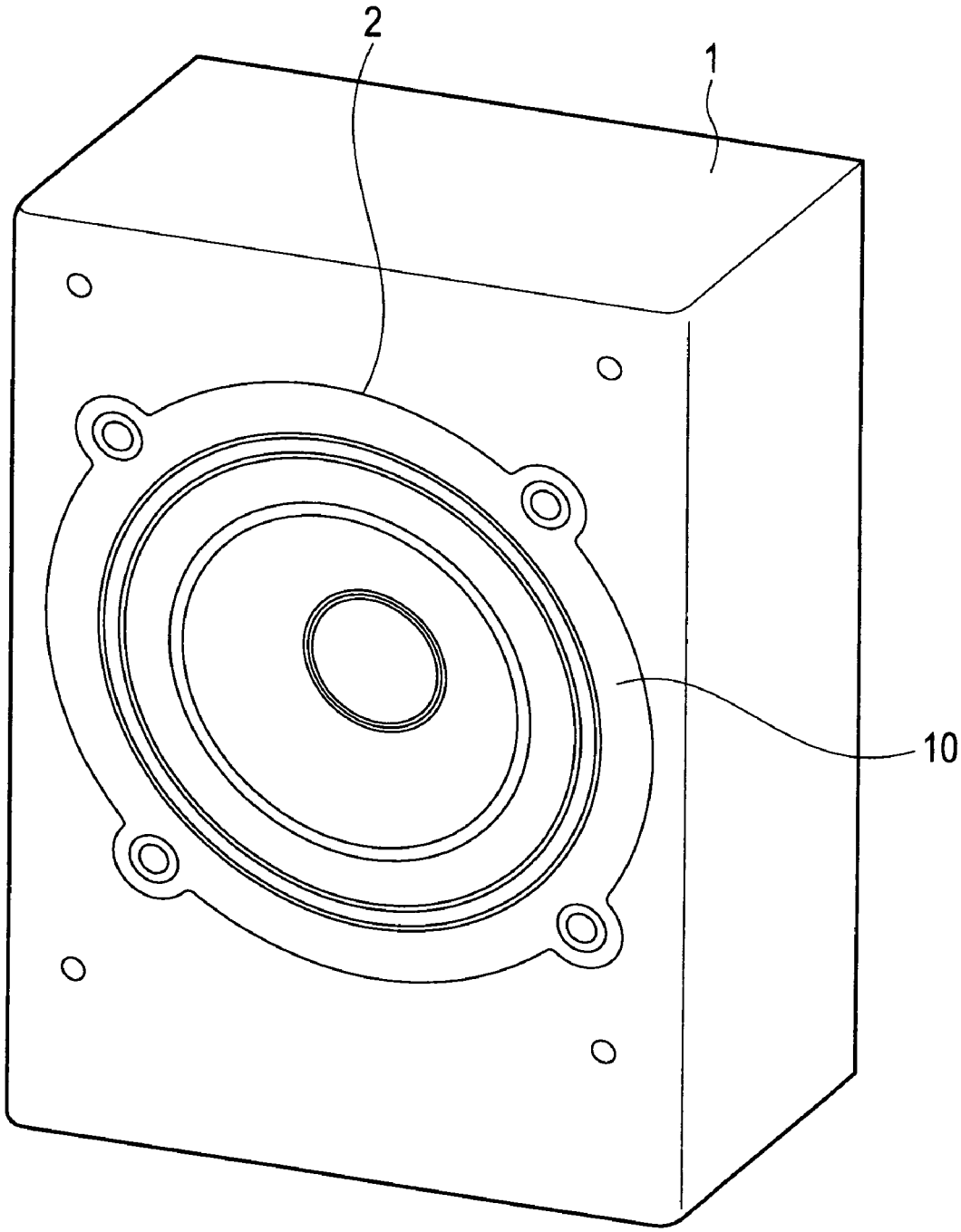
FIG. 1 is a perspective view illustrating a speaker according to an embodiment of the present invention.

As shown in FIG. 1, a speaker according to an embodiment of the present invention includes: a cabinet 1 having a unit mounting opening 2 on a front surface thereof; and a speaker unit 10 mounted on the unit mounting opening 2.

As the cabinet 1, for example, a bass reflex type wooden box body or the like is usable. In FIG. 1, a full range speaker with a one-way structure is illustrated; however, a tweeter, a midrange speaker, a woofer and the like may be mounted on the cabinet 1, and a speaker module with a two to five-way structure may be constructed.

Figure 2:
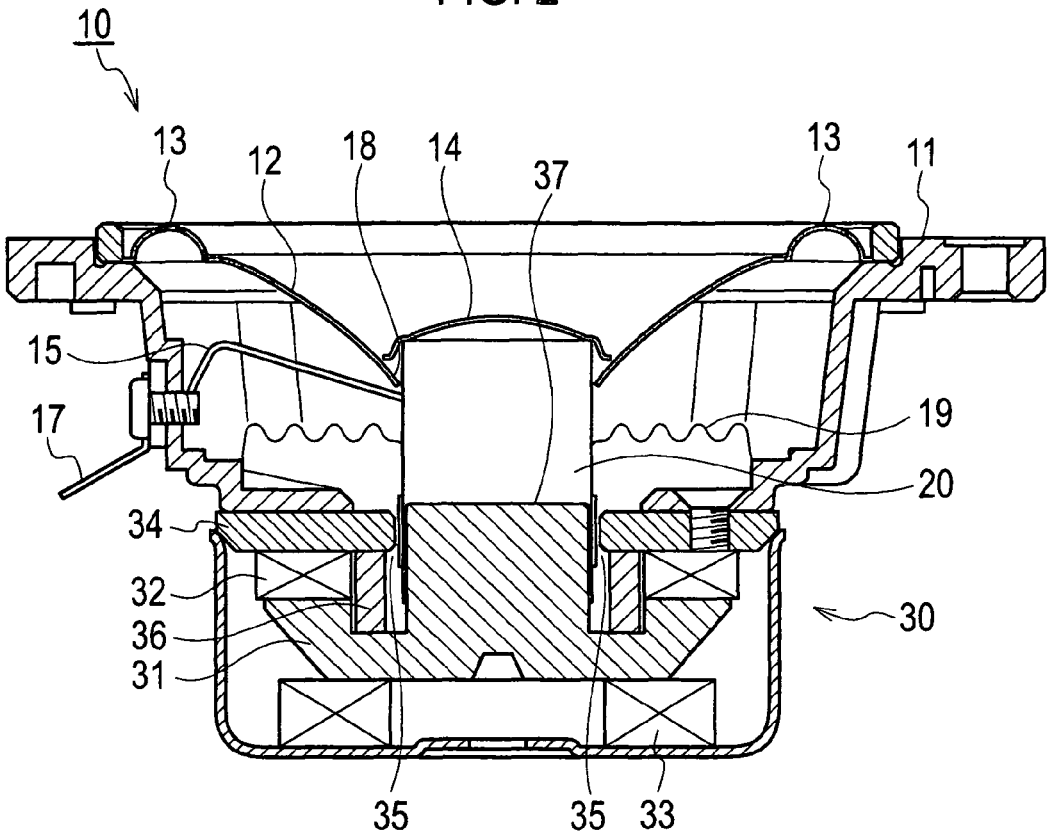
FIG. 2 is a cross-sectional view illustrating a speaker unit according to the embodiment of the present invention.

As shown in FIG. 2, the speaker unit 10 includes: a diaphragm 12, a frame 11 that houses the diaphragm 12 therein; a voice coil 20 connected to the diaphragm 12; and a magnetic circuit 30 magnetically connected to the voice coil 20 under the frame 11.

As shown in FIG. 2, the diaphragm 12 has a cone (conic) shape in cross section, and an opening portion 18 is provided in a center thereof. A dust cap 14 for preventing intrusion of foreign objects into the voice coil 20 is attached onto the opening portion 18. A coupling member 13 such as a rubber edge is attached onto an entire outer circumferential portion of the diaphragm 12. The coupling member 13 is fixed to the frame 11, which houses the diaphragm 12 therein, while interposing a gasket or the like therebetween. An inner circumferential portion of the diaphragm 12 is adhered to an outer circumferential portion of the voice coil 20 by an adhesive or the like. A damper 19 is connected to the voice coil 20 and to an inside of the frame 11. A lead wire 15 is extracted from the voice coil 20. The lead wire 15 is connected to a terminal 17 attached onto the frame 11.

The magnetic circuit 30 includes: a yoke 31 opposite to the frame 12; doughnut-like magnets 32 and 33 provided adjacent to the yoke 31; a top plate 34 disposed on the magnet 32; a copper cap 37 provided on a center pole of the yoke 31; and a short ring 36 disposed so as to surround a circumference of the center pole. The voice coil 20 is freely fitted into a magnetic gap 35 between the top plate 34 and the center pole of the yoke 31.

—Voice Coil—

Figure 3:
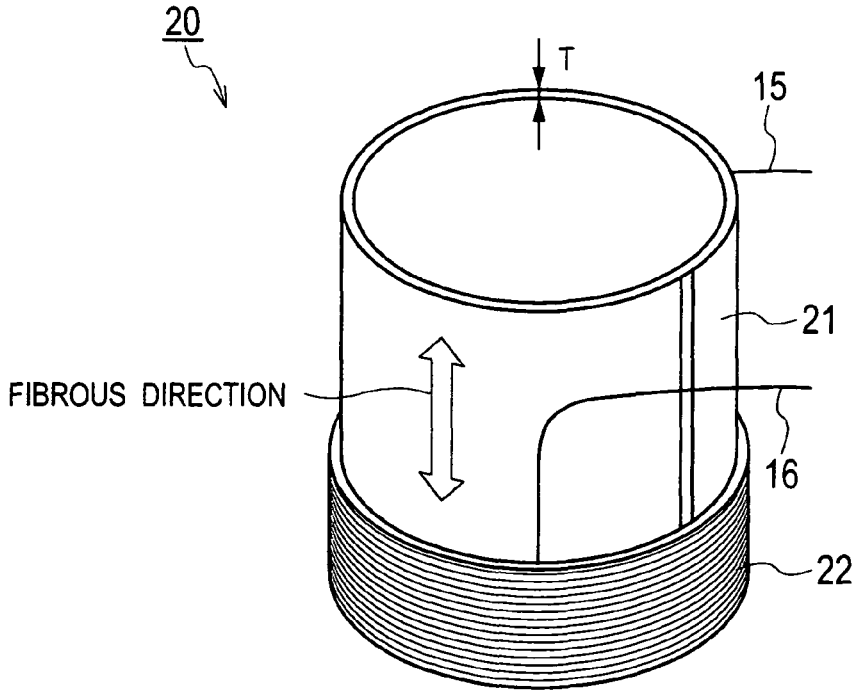
FIG. 3 is a perspective view illustrating a voice coil according to the embodiment of the present invention.

As shown in FIG. 3, the voice coil 20 includes: a cylindrical wooden bobbin 21; a coil 22 that surrounds an outer circumference of the bobbin 21; and the lead wires 15 and 16 extracted from the coil 22. It is desirable that the bobbin 21 be formed of a wooden sheet having a fiber direction in a transmission direction of the vibrations, that is, in a direction substantially perpendicular to a winding direction of the coil 22. The wooden sheet is fibrous, and a sound propagation velocity thereof in the fiber direction exhibits a higher value than that in the direction perpendicular to the fiber direction. Accordingly, the transmission direction of the vibrations and the fiber direction are made to coincide with each other, thus making it easier to transmit the vibrations of the voice coil 20 to the diaphragm 12.

A thickness T of the bobbin 21 can be changed in response to sizes of vessels and wood cells of lumber for use. However, it is preferable that the thickness T be set, for example, at approximately 0.06 mm to 0.6 mm in consideration for strength of the lumber in the case of processing the lumber concerned into such a cylindrical shape since a crack sometimes occurs therein in the fiber direction in the above-described case of processing the lumber into the cylindrical shape. Note that, in order to suppress deformation and fracture of the wooden sheet, it is preferable that a resin, a lubricant and the like be impregnated in advance into an inside and surface of the wooden sheet.

In the case of using only natural wood as the material, the strength, moldability and form stability cannot sometimes be obtained sufficiently. In this case, a reinforcing sheet with a thickness of 0.03 mm to 0.1 mm may be laminated on a back side of the wooden sheet, which serves as an inner circumferential surface of the bobbin 21. The reinforcing sheet may be laminated entirely on such a back surface of the wooden sheet, or may be laminated partially on a portion thereof where the strength is required. As the reinforcing sheet, for example, Japanese paper, kraft paper and the like are suitable.

As a material of the wooden sheet, natural wood is preferable, which satisfies the following respective conditions: for example, that it is easy to form the wooden sheet, that good acoustic characteristics are inherent, and so on in addition to that a vessel density is uniform and small, that the vessels are short, that such wood fiber is long, that growth of a summer-wood phase is slow, and so on. For example, birch-series materials such as monarch birch and gold birch, a magnolia bark material, maple-series materials such as painted maple and hard maple, cherry and the like can be suitably used. The wooden sheet is obtained by slicing a log, the lumber or the like to a predetermined thickness.

As the coil 22, for example, a copper-made electric wire can be used. The coil 22 is wound to plural layers around the bobbin 21 in a horizontal direction of a page space of FIG. 3.

Figure 4:
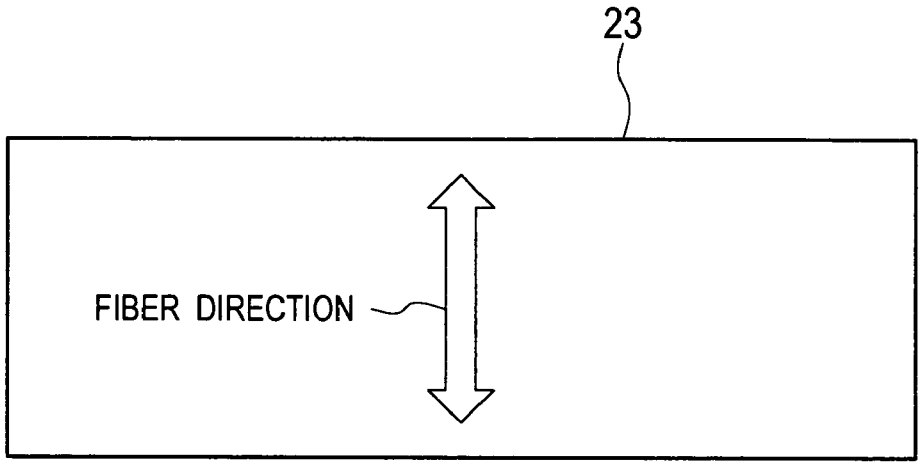
FIG. 4 is an explanatory diagram illustrating a method of manufacturing a voice coil according to the embodiment of the present invention.
Figure 5:
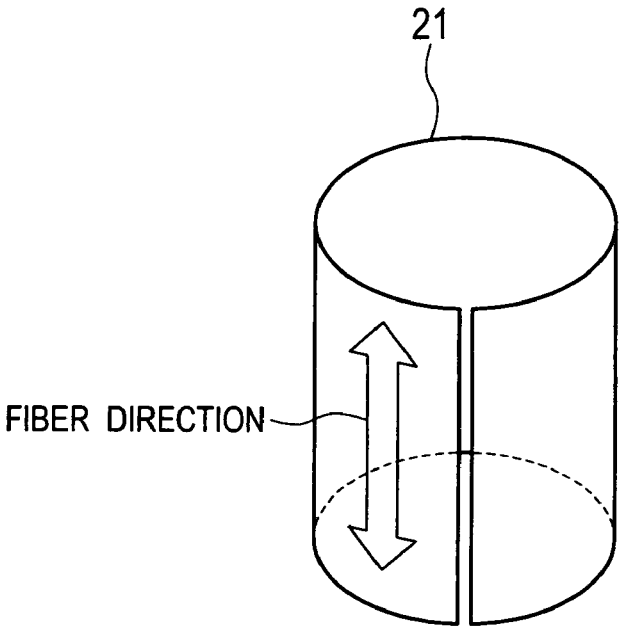
FIG. 5 is an explanatory diagram illustrating a method of manufacturing the voice coil according to the embodiment of the present invention.

In the case of fabricating the voice coil 20 shown in FIG. 3, as shown in FIG. 4, a rectangular wooden sheet 23 having the fiber direction in a vertical direction of a page space is prepared. Then, as shown in FIG. 5, the wooden sheet 23 is rolled to a cylindrical shape, whereby the bobbin 21 is fabricated. Then, the coil 22 just needs to be wound around the bobbin 21 with a constant winding width and a constant number of layers, and the lead wires 15 and 16 just need to be extracted from the coil 22.

As described above, in accordance with the voice coil 20 according to the embodiment of the present invention, the bobbin 21 is formed of the wooden sheet. In the wooden sheet, the sound propagation velocity in the fiber direction is faster than that in such a non-fiber direction. Accordingly, the fiber direction and the sound propagation direction are made to coincide with each other, thus making it possible to easily transmit the vibrations to the diaphragm 12 more efficiently. Moreover, the wooden sheet has the propagation velocity (approximately 5000 m/s) equivalent to that of the aluminum in the fiber direction. Accordingly, the wooden sheet can realize a response equivalent to that of the aluminum, and does not receive magnetic damping. Therefore, the wooden sheet can transmit the vibrations of the voice coil 20 to the diaphragm with higher fidelity. Furthermore, the wooden sheet has excellent characteristics in overall aspects including the sound propagation velocity, weight, the strength, a vibration transmission capability and the like even in comparison with the conventional materials such as the paper, aramid fiber and polyimide. Accordingly, it becomes possible to reproduce a sound that has not been able to be expressed by means of the conventional materials.

Figure 6:
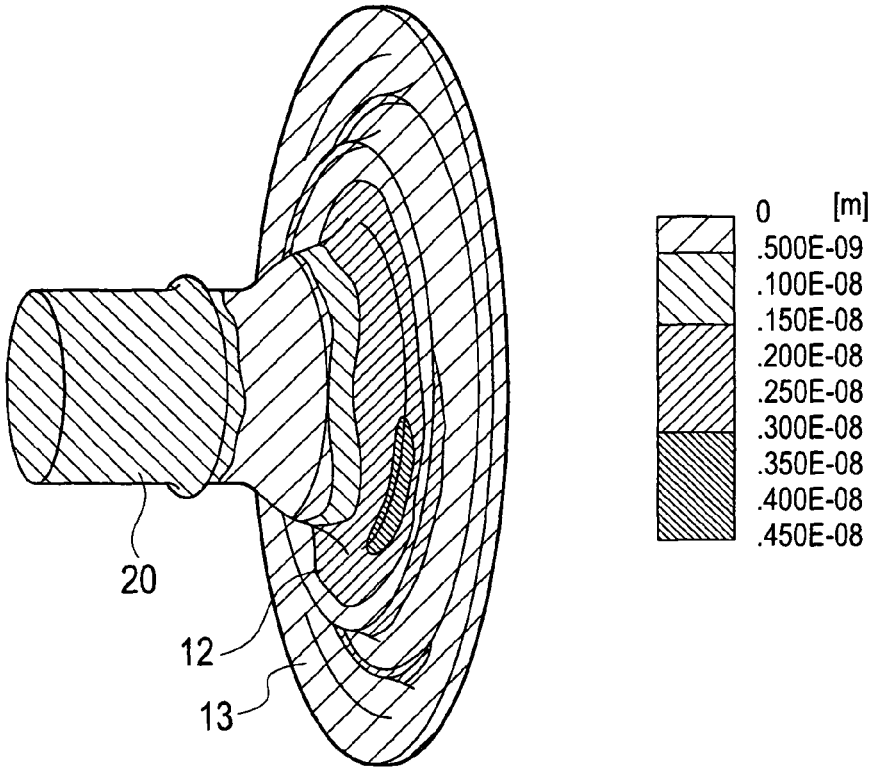
FIG. 6 is an explanatory diagram illustrating a simulation result of vibrations of a speaker according to the embodiment of the present invention.

FIG. 6 is a schematic diagram of a result of simulating a state of the vibrations in the case of operating the speaker including the voice coil 20 according to the embodiment of the present invention at a frequency of 13 kHz (13000 Hz). As obvious from contour lines of FIG. 6, vibrations in the vicinity of the outer circumferential portion of the diaphragm 12 are approximately $0.45\times10^{-8}$ m, and it is understood that the vibrations of the voice coil 20 are transmitted satisfactorily to the entirety of the diaphragm 12.

Figure 7:
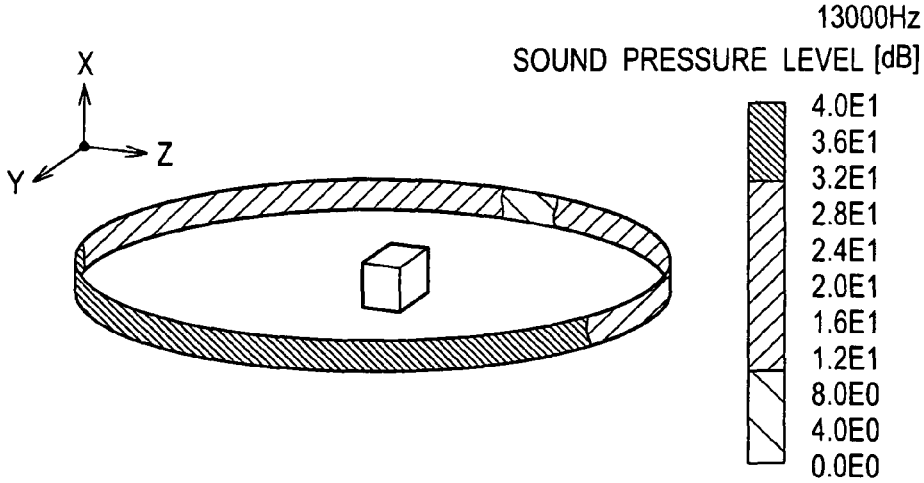
FIG. 7 is an explanatory diagram illustrating a simulation result of acoustic output characteristics of a speaker according to the embodiment of the present invention.

FIG. 7 shows an outline of a result of a measurement performed in such a manner that the speaker according to the embodiment of the present invention was mounted on a turn table (not shown) and that acoustic output characteristics thereof were then evaluated by a microphone at places radially apart by 1 m from a center of the turn table. As shown in FIG. 7, it is understood that, while a sound pressure level of a front surface (y-axis direction) of the speaker was approximately 40 dB, a sound pressure level as high as approximately 16 dB was able to be maintained also on a back surface of the speaker.

Figure 8:
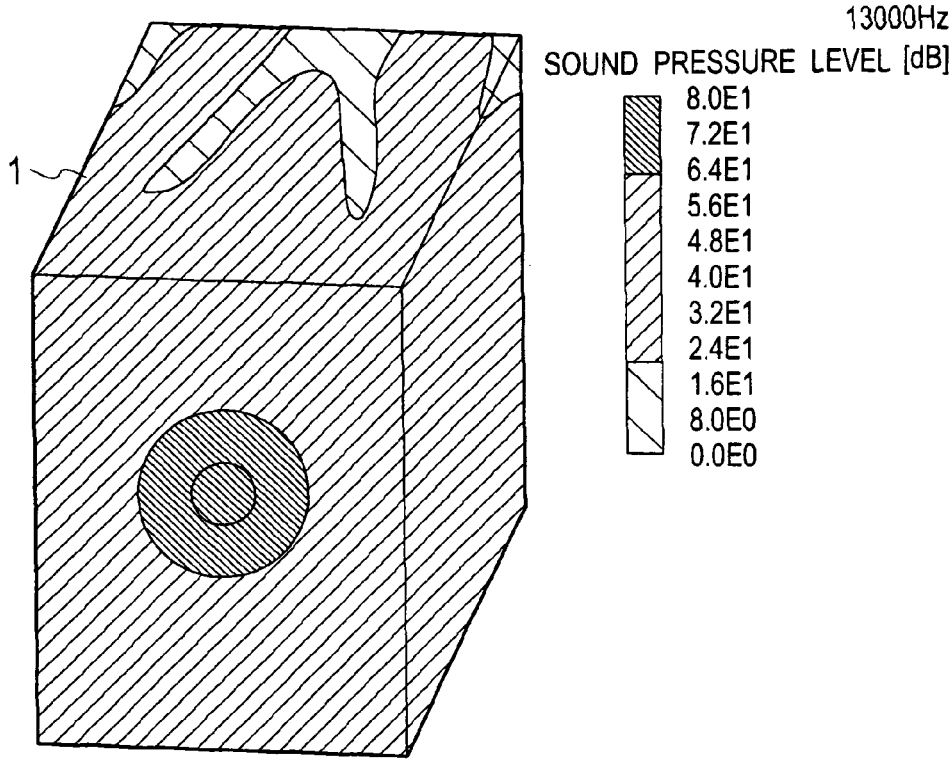
FIG. 8 is an explanatory diagram illustrating a simulation result of a surface sound pressure distribution of a speaker according to the embodiment of the present invention.

FIG. 8 shows an outline of a result of simulating a surface sound pressure distribution of the speaker according to the embodiment of the present invention. As shown in FIG. 8, it is understood that a center portion of the front surface of the cabinet 1 exhibits a sound pressure level as high as approximately 80 dB, and that a peripheral portion of the front surface of the speaker can also maintain a sound pressure level of approximately 40 dB.

Figure 9:
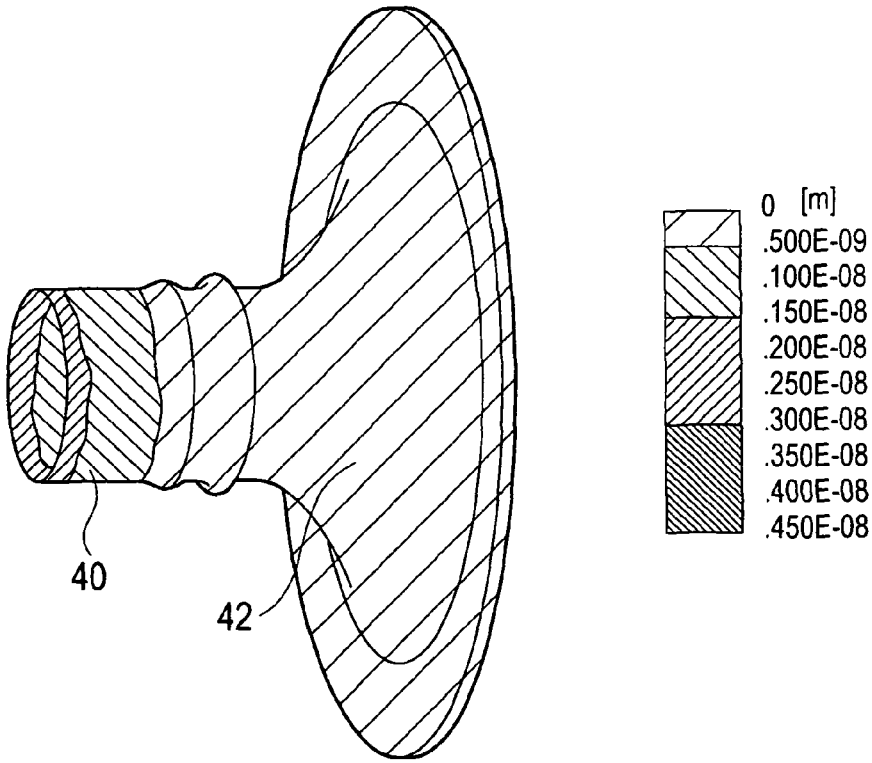
FIG. 9 is an explanatory diagram illustrating a simulation result of vibrations of a speaker according to a comparative example.
Figure 10:
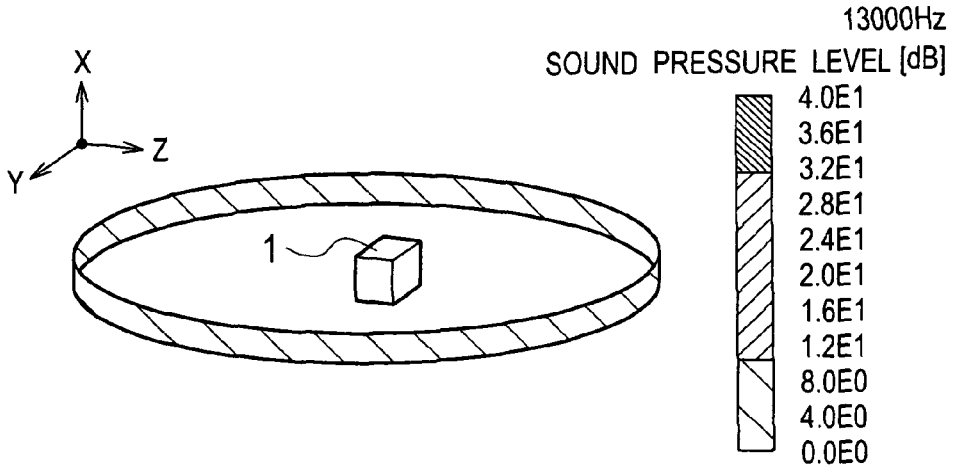
FIG. 10 is an explanatory diagram illustrating an simulation result of acoustic output characteristics of a speaker according to the comparative example.
Figure 11:
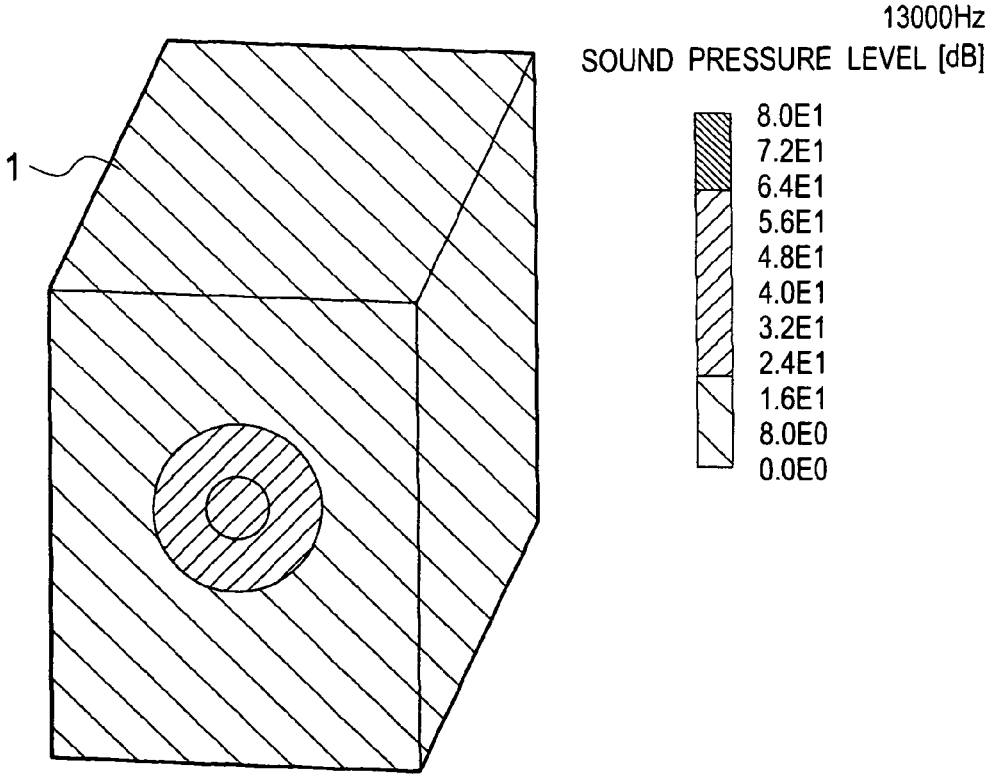
FIG. 11 is an explanatory diagram illustrating a simulation result of a surface sound pressure distribution of a speaker according to the comparative example.

As a comparative example, FIG. 9 shows a state where a voice coil 40 and a diaphragm 42 vibrate in the case of using the conventional kraft paper under the same conditions as those of the speaker according to the embodiment of the present invention. A magnitude of the vibrations transmitted from the diaphragm is approximately $0.5\times10^{-9}$ m, and it is understood that the magnitude is largely deteriorated in comparison with the speaker according to the embodiment of the present invention, which is shown in FIG. 6. Moreover, also seen from results of the comparative example, which are shown in FIG. 10 and FIG. 11, it is understood that an acoustic output of the comparative example is lower than in the case shown in FIG. 7 and FIG. 8 (present invention), and that the sound pressure level rises only on the center of the front surface of the cabinet 1 and the vicinity thereof.

Figure 12:
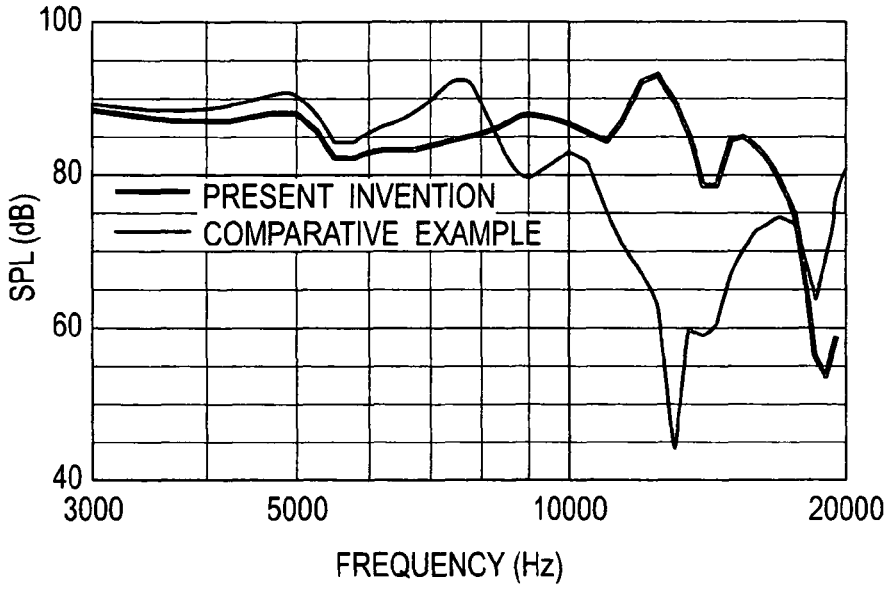
FIG. 12 is a graph illustrating sound pressure frequency characteristics of a speaker according to the embodiment of the present invention and a speaker according to the comparative example.

FIG. 12 shows a comparison between a result of simulating sound pressure frequency characteristics of the speaker according to the embodiment of the present invention and a result of simulating those of the speaker of the comparative example. As shown in FIG. 12, it is understood that, though a large drop of the sound pressure level (SPL value) is observed at around 13000 Hz in the speaker of the comparative example, the speaker according to the embodiment of the present invention can highly maintain the sound pressure level (SPL value) in any frequency range.

Figure 13:
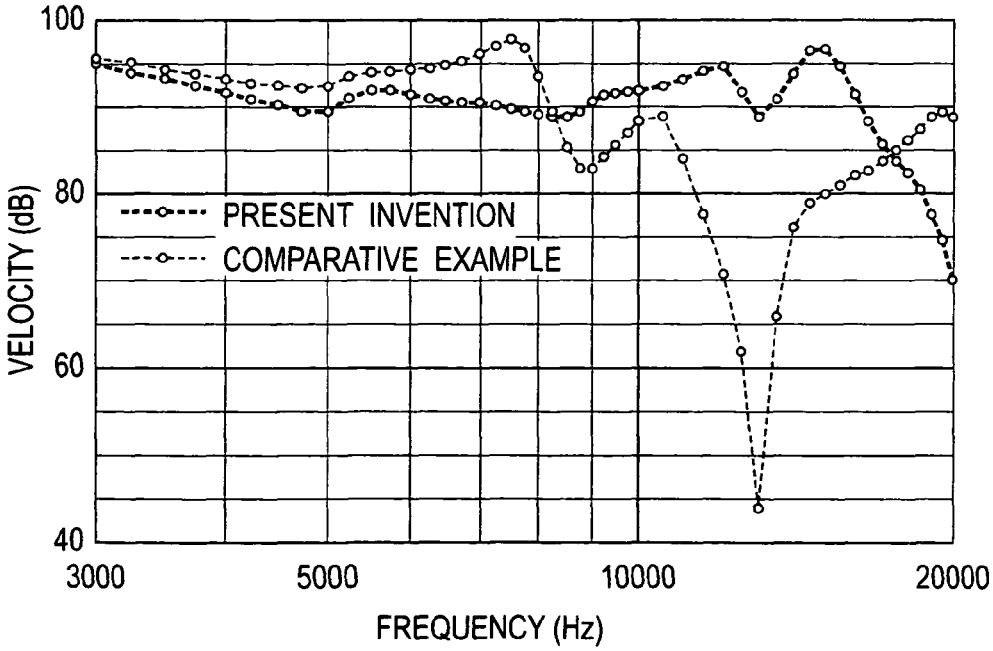
FIG. 13 is a graph illustrating a simulation result of sound velocities of a center portion of a speaker unit in a speaker according to the embodiment of the present invention and a speaker unit according to the comparative example.

FIG. 13 shows results of simulating sound velocities of center portions of the speaker units 10 in the speaker according to the embodiment of the present invention and the speaker of the comparative example. It is understood that, while the speaker according to the embodiment of the present invention exhibits a value as high as approximately 90 dB in a frequency range of 10000 to 20000 Hz, a large drop of the sound velocity is observed at around 13000 Hz in the speaker of the comparative example.

Figure 14:
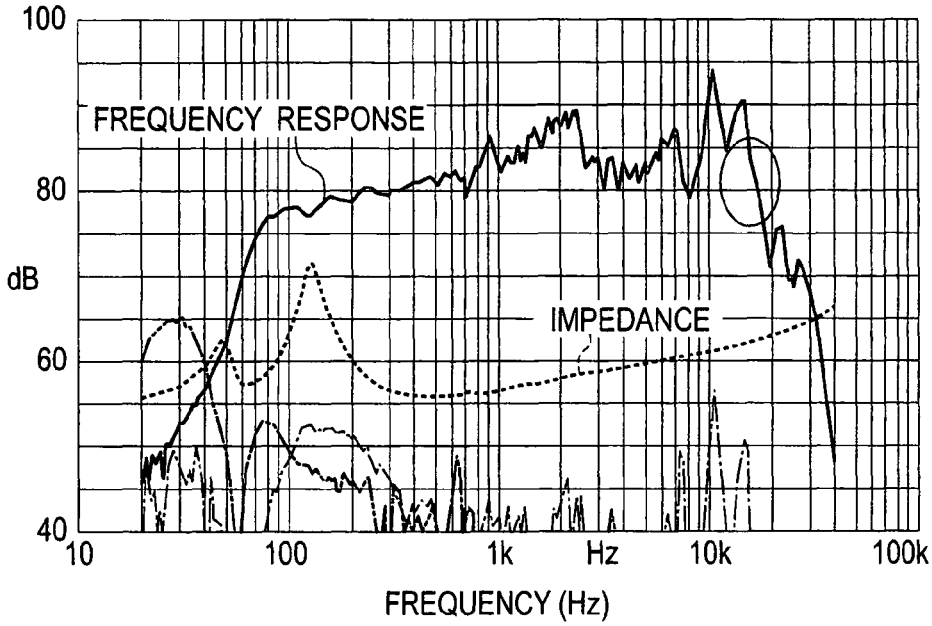
FIG. 14 is a graph illustrating frequency characteristics of a speaker according to the embodiment of the present invention.
Figure 15:
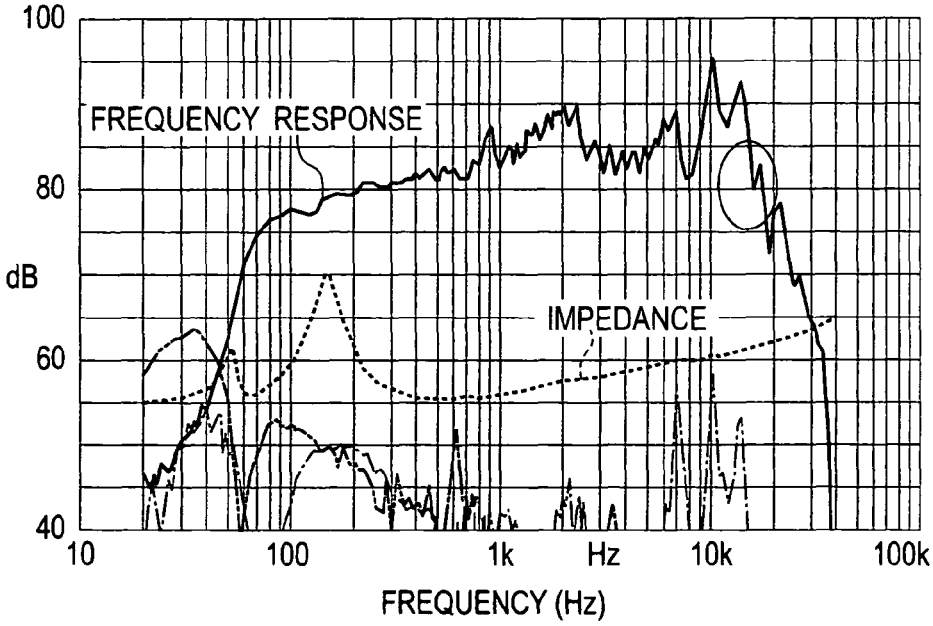
FIG. 15 is a graph illustrating frequency characteristics of a speaker according to the comparative example.

FIG. 14 shows frequency characteristics in the case of using the speaker according to the embodiment of the present invention, and FIG. 15 shows frequency characteristics in the case of using the speaker of the comparative example. When FIG. 14 and FIG. 15 are compared with each other, it is understood that, while a drop of the frequency characteristics is observed at around 13 kHz in FIG. 15 showing the comparative example, such a drop is improved in an example according to the embodiment of the present invention, which is shown in FIG. 14.

As described above, since the wooden bobbin 21 is used, the voice coil and the speaker, which are according to the embodiment of the present invention, have the high propagation velocity, are lightweight and strong, and are capable of transmitting the vibrations with high efficiency. Accordingly, in accordance with the voice coil and the speaker, the sound that has not been able to be reproduced heretofore can be reproduced.

(Other Embodiments)

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

For example, the description has been made of the speakers shown in FIG. 1 to FIG. 15 by taking as an example the case of using the conic diaphragm 12; however, it is a matter of course that a similar configuration to that of the conic diaphragm 12 is also applicable to a dome-like diaphragm.

What is claimed is:

1. A voice coil comprising:

a bobbin formed of a wooden sheet obtained by slicing natural wood to a predetermined thickness; and a coil which surrounds an outer circumference of the bobbin, wherein the bobbin has a fiber direction in a direction substantially perpendicular to a winding direction of the coil.

2. The voice coil of claim 1, wherein the predetermined thickness of the bobbin is in a range of from 0.06 mm to 0.6 mm.

3. The voice coil of claim 1, further comprising a reinforcing sheet provided on a back side of the wooden sheet.

4. The voice coil of claim 3, wherein the reinforcing sheet is a paper.

5. The voice coil of claim 3, wherein a thickness of the reinforcing sheet is in a range of from 0.03 mm to 0.1 mm.

6. A speaker comprising:

a bobbin formed of a wooden sheet obtained by slicing natural wood to a predetermined thickness;

a coil which surrounds an outer circumference of the bobbin;

a diaphragm connected to an end portion of the coil; and a magnetic circuit magnetically connected to the coil, wherein the bobbin has a fiber direction in a direction substantially perpendicular to a winding direction of the coil.

7. The speaker of claim 6, wherein the predetermined thickness of the bobbin is in a range of from 0.06 mm to 0.6 mm.

8. The speaker of claim 6, further comprising a reinforcing sheet provided on a back side of the wooden sheet.

9. The speaker of claim 8, wherein the reinforcing sheet is a paper.

10. The voice coil of claim 8, wherein a thickness of the reinforcing sheet is in a range of from 0.03 mm to 0.1 mm.

* * * * *